US006527109B2

(12) United States Patent
Schoo et al.

(10) Patent No.: US 6,527,109 B2
(45) Date of Patent: Mar. 4, 2003

(54) CONTAINER CAP WITH LIQUID-DISSOLVABLE ADDITIVE

(76) Inventors: William W. Schoo, 4396 Windjammer La., Fort Myers, FL (US) 33917; Sheryl A. Mulne, 1337 Brookwood Pl., Columbus, OH (US) 43209; Cynthia S. Levy, 18 Lyons Gate Rd., Bexley, OH (US) 43209; Stephanie S. King, 1851 Hove, Columbus, OH (US) 43221; J. Craig Mullins, 4044 Forest Edge Dr., Gahanna, OH (US) 43230

( * ) Notice: Subject to any disclaimer, the term of this patent is extended or adjusted under 35 U.S.C. 154(b) by 0 days.

(21) Appl. No.: 09/884,826

(22) Filed: Jun. 19, 2001

(65) Prior Publication Data

US 2002/0189956 A1 Dec. 19, 2002

(51) Int. Cl.[7] ..... B65D 25/08

(52) U.S. Cl. ..... 206/219; 426/115; 426/112; 426/66; 220/705; 215/215

(58) Field of Search ..... 215/215, 230, 215/387, 388; 220/705, 717, 256.1, 259.1; 426/115, 112, 66, 85; 206/219

(56) References Cited

U.S. PATENT DOCUMENTS

| | | | | | |
|---|---|---|---|---|---|
| 2,631,521 | A | * | 3/1953 | Atkins, Jr. | 99/275 |
| 2,824,010 | A | * | 2/1958 | Pedersen | 426/120 |
| 4,221,291 | A | * | 9/1980 | Hunt | 206/222 |
| 4,793,475 | A | * | 12/1988 | Itzel | 206/221 |
| 5,085,335 | A | * | 2/1992 | Carbaugh | 220/709 |
| 5,094,861 | A | * | 3/1992 | D'Auguste et al. | 426/85 |
| 5,772,017 | A | * | 6/1998 | Kang | 206/222 |
| 5,984,141 | A | * | 11/1999 | Gibler | 222/80 |

* cited by examiner

*Primary Examiner*—Mickey Yu
*Assistant Examiner*—Troy Arnold
(74) *Attorney, Agent, or Firm*—Jason H. Foster; Kremblas, Foster, Phillips & Pollick

(57) ABSTRACT

A cap for a water bottle or other liquid container. The cap has a liquid-dissolvable disk in it that dissolves in the water when the bottle is shaken. The preferred cap also has an annular cavity between inner and outer walls in the sidewall of the cap into which the liquid can flow through fluid passageways once the disk is at least partially dissolved.

16 Claims, 7 Drawing Sheets

CONTAINER CAP WITH LIQUID-DISSOLVABLE ADDITIVE

(e) BACKGROUND OF THE INVENTION

1. Field of the Invention

This invention relates generally to a cap for a liquid container, and more particularly to a cap containing a liquid-dissolvable additive within the cap for dissolving in liquid in the container.

2. Description of the Related Art

It is known to combine one material with another to dissolve the first in the second. This can be accomplished in an open or closed vessel. It is often undesirable manually to combine materials when there is a possibility that the person combining the materials could come into contact with one or both materials. The reason given in the prior art for this undesirability is that the materials may be toxic or otherwise harmful to the person combining, or the materials may be sanitary, and contact by the person would contaminate the materials. Furthermore, mixing two materials is inconvenient, especially if one of the containers has a small opening, such as on a drink bottle, which makes pouring the additive into the container difficult.

It is conventionally known to place a liquid in a container and place a second material, whether liquid or particulate, in the lid for that container. Upon taking some step, such as actuating a mechanism in the lid, the person combining the materials exposes the material in the lid to the liquid in the container, thereby permitting mixing of the two. In many such conventional devices, the steps required to mix are complex, and are not on a simple, convenient device. Furthermore, complete separation of the ingredients prior to mixing is not always convenient or necessary.

Therefore, the need exists for a device that permits a user to combine an additive with a liquid in such a way that is simple and convenient to execute, inexpensive to manufacture, and provides some level of separation between the user and the materials to be combined prior to combination. Such a structure would be easily used by anyone of virtually any age and physical ability, and would not involve any complex assembly or disassembly.

(f) BRIEF SUMMARY OF THE INVENTION

The invention is a cap for mounting on a liquid container. The cap comprises a sidewall having an inwardly facing surface defining an interior chamber. The sidewall also has an outwardly facing surface, and a receiving end adapted to receive a portion of the liquid container. The receiving end has an opening to the chamber for placing the chamber in fluid communication with liquid in the liquid container. A top end of the sidewall is opposite the receiving end.

A liquid-dissolvable body is mounted within the chamber between the receiving end and the top end. At least part of the liquid-dissolvable body is in fluid communication with the chamber so that liquid from the liquid container that is poured into the chamber contacts the body and at least partially dissolves the body in the liquid.

When the cap is mounted on a liquid container, such as by screwing it onto a conventional water bottle, the water in the bottle dissolves the liquid-dissolvable body, which can be an additive such as fluoride, vitamins, flavoring, etc. The water, thereafter containing the additive, can be consumed so as to conveniently gain the benefit of the additive.

In a preferred embodiment, the sidewall further comprises an inner wall and an outer wall spaced apart forming at least one cavity therebetween. The liquid-dissolvable body abuts the inner wall and is interposed between the chamber and the cavity. There are also fluid passageways extending through the inner wall between the cavity and the chamber. The fluid passageways are blocked by the liquid-dissolvable body abutting the inner wall at the fluid passageways until the blocking part of the body dissolves. The body thereby restricts fluid flow from the chamber to the cavity until after a passageway-blocking portion of the body is dissolved. If the body contains a colored additive, the fact of the additive's dissolution in the liquid will be apparent from the outside of the cap, because the colored water will be visible in the cap's cavity.

(g) BRIEF DESCRIPTION OF THE SEVERAL VIEWS OF THE DRAWINGS

Figure 1:
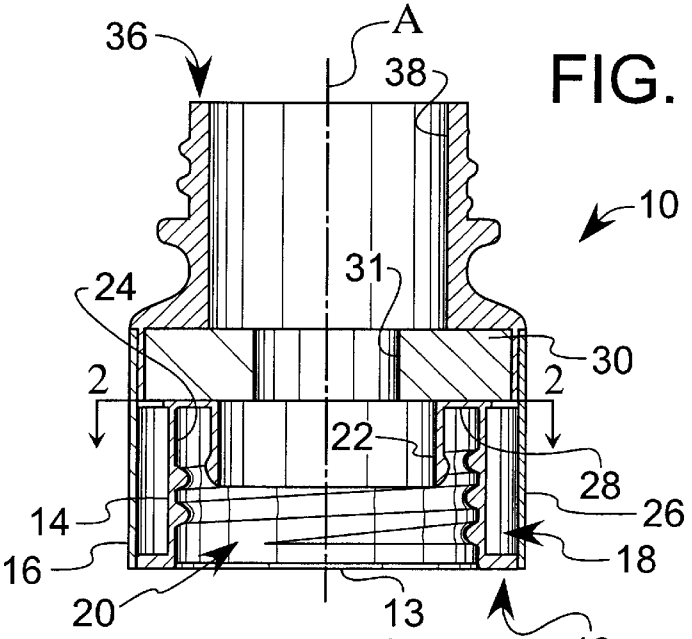
FIG. 1 is a side view in section illustrating the preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

(h) DETAILED DESCRIPTION OF THE INVENTION

The preferred cap 10 is shown in FIG. 1 having a circular cylindrical sidewall 12 with an axis A. The sidewall 12 has an inner wall 14 and an outer wall 16 that are spaced radially from one another, forming an annular cavity 18 therebetween that is coaxial with the axis A. The inwardly facing surface 24 of the inner wall 14 defines a circular cylindrical chamber 20 within the cap 10. The outwardly facing surface 26 of the outer wall 16 is preferably a circular cylinder, but could be any other shape, such as the decorative shape shown in FIGS. 6 and 7 and described below. Alternatively, or additionally, the outwardly facing surface 26 could be imprinted with indicia. In the description of the instant invention, the word "indicia" includes imprinting or otherwise applying coloration or shading, and includes surface relief or protrusions.

Figure 5:
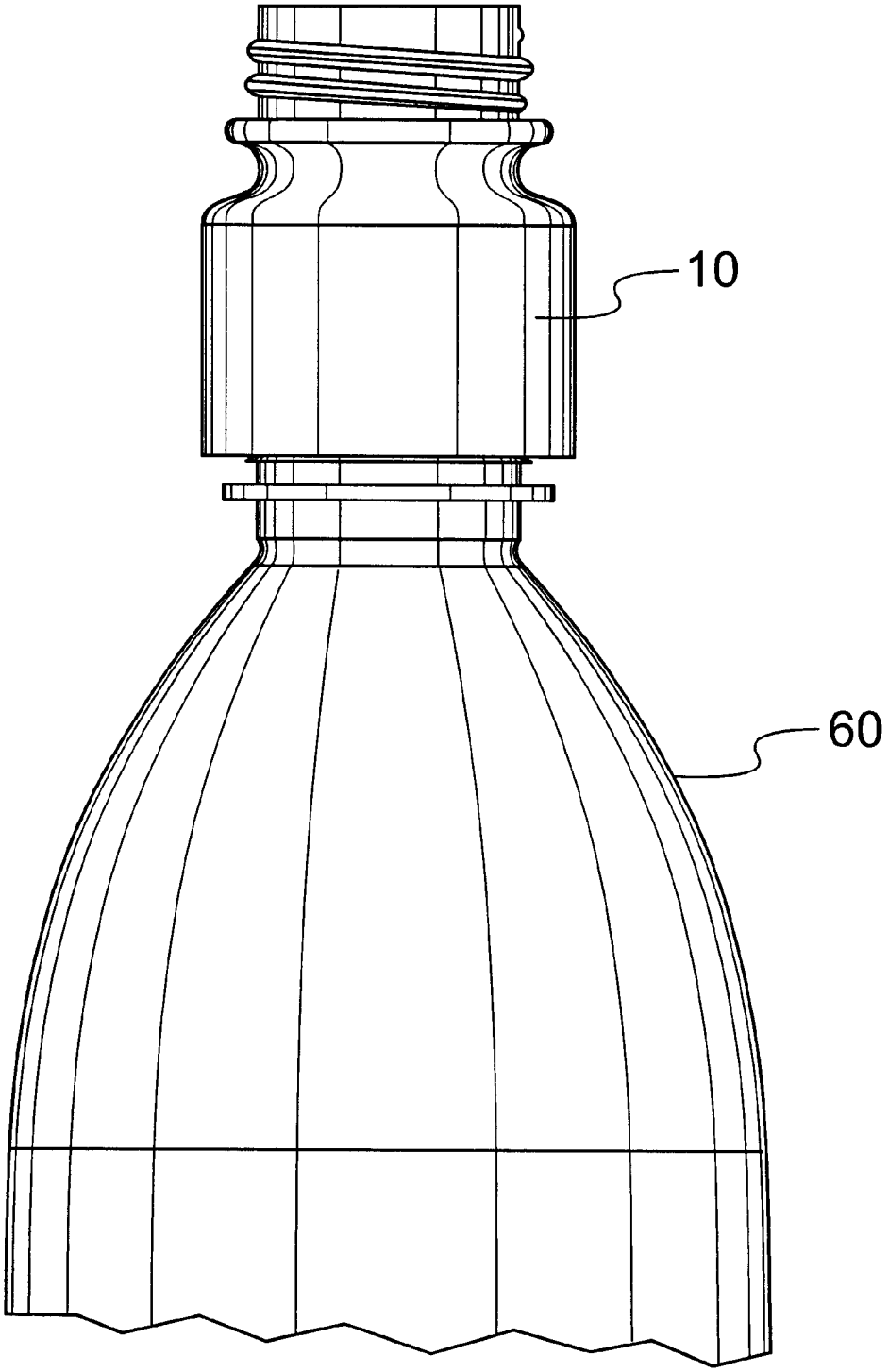
FIG. 5 is a side view illustrating the cap in a preferred attachment on a conventional water bottle.
Figure 12:
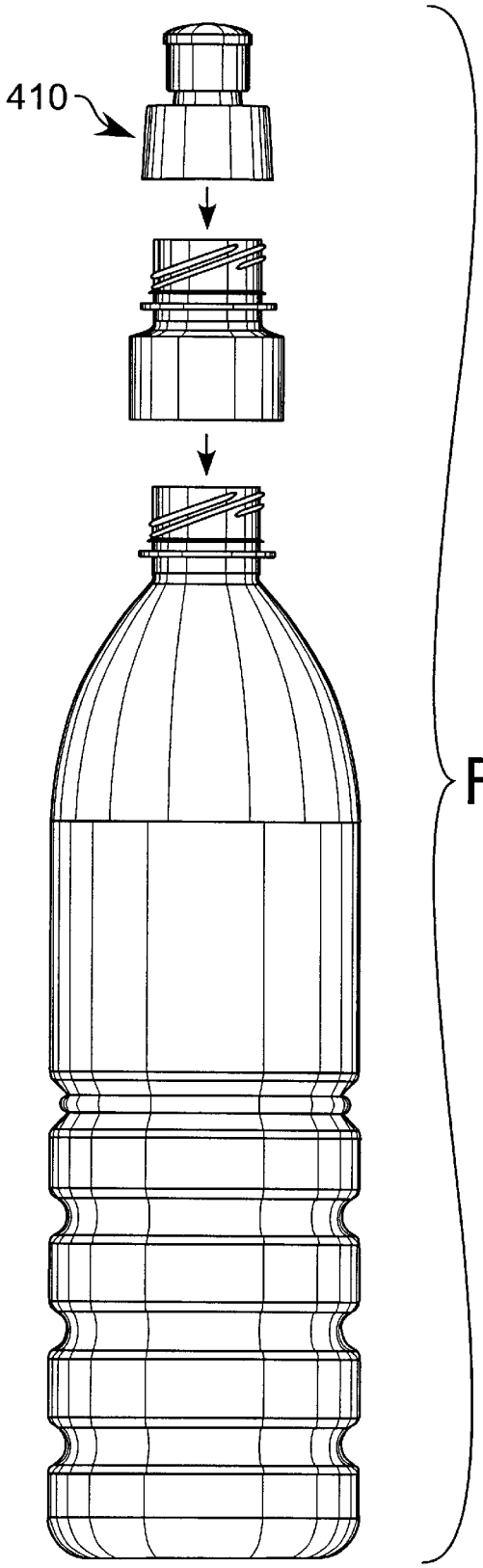
FIG. 12 is an exploded side view illustrating an embodiment of the invention on a bottle.
Figure 13:
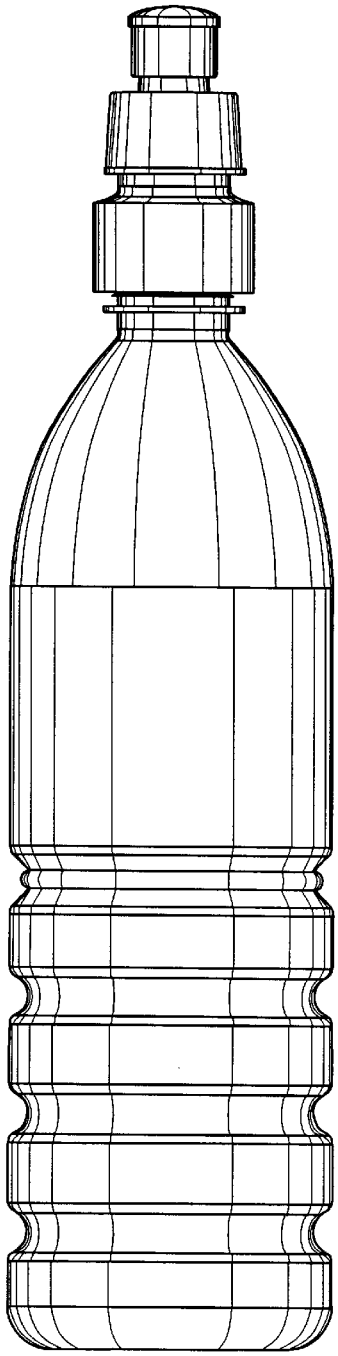
FIG. 13 is a side view illustrating an embodiment of the invention on a bottle.

The collar 22 is a cylindrical structure extending axially downwardly (in the orientation shown in FIG. 1) from a web 28 that extends radially inwardly from the inner wall 14. As shown in FIGS. 5, 12 and 13, the cap 10 can be mounted to a conventional water bottle, or any other liquid container such as a jar, a baby bottle, etc., so long as the size of the cap is modified appropriately as will become apparent to one of ordinary skill in the art from the present description.

When the cap 10 is attached to a bottle, the spout of the bottle is inserted into the receiving end 13 of the cap 10 and is interposed between the inner wall 14 and collar 22 of the cap 10. The inwardly extending, helical threads on the inner wall 14 engage the outwardly extending, helical threads on the radially outwardly facing surface of the spout (see FIG. 12). In this configuration, the cap 10 is rigidly mounted to the spout of the bottle with the collar 22 seated against the radially inwardly facing surface of the spout to prevent liquid from entering the space between the collar 22 and the inner wall 14. The collar thereby insures that any liquid that is in the bottle can only pass through the region of the chamber 20 extending through the collar 22 and above (in the FIG. 1 orientation).

The cap 10 has a spout 36 with a sidewall 38 having a preferably circular cylindrical passage therethrough. On the radially outwardly facing surface of the spout 36, there are conventional helical threads for engaging a conventional water bottle cap of the type show in FIG. 14 or of the sport-cap type as shown in FIG. 13. The cap shown in FIG. 14 includes elements of the present invention, and therefore the cap mounted to the spout 36 would preferably not have the structures shown in the FIG. 14 cap that are part of the present invention.

Figure 3:
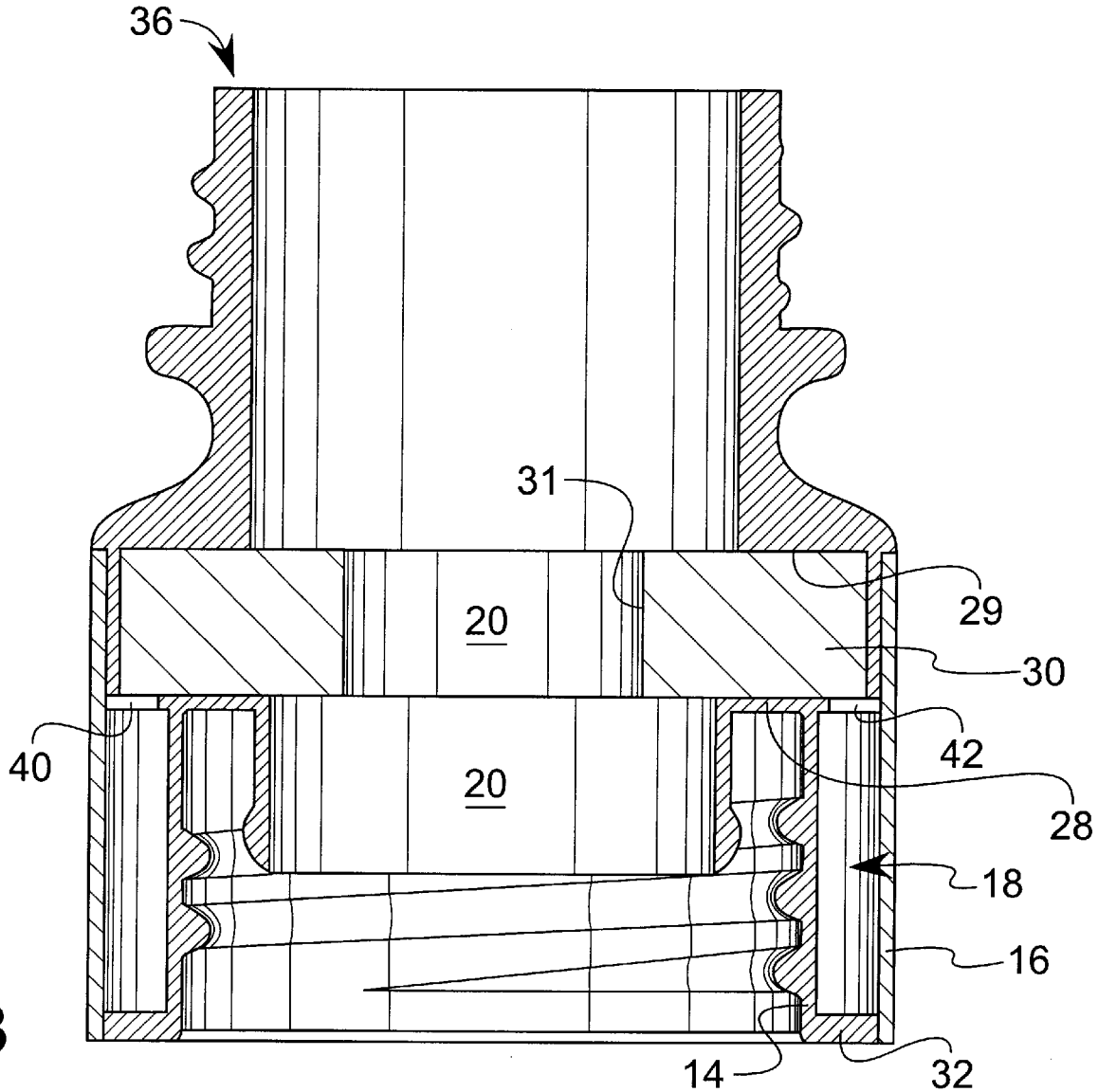
FIG. 3 is an enlarged view illustrating the cap of FIG. 1.

Referring to FIG. 3, the cavity 18 in the cap sidewall 12 is defined by an annular gap between the radially outwardly facing surface of the inner wall 14, the radially inwardly facing surface of the outer wall 16, the radial web 28 and the radial web 32, both of which are part of the inner wall 14. The cavity 18 extends, in the preferred embodiment, circumferentially and contiguously around the cap 10.

The fluid passageways 40 and 42 (and other fluid passageways shown in FIG. 2 and described below) are formed on the web 28, extending between the chamber 20 and the cavity 18. Thus, the cavity and the chamber 20 are in fluid communication with one another so long as nothing blocks the fluid passageways. However, in a preferred embodiment, there is a liquid-dissolvable body, preferably the annular disk 30, rigidly mounted in the chamber 20 to block the fluid passageways. The disk 30 contains an additive that will eventually be completely dissolved in, and thereby incorporated into, a liquid, such as water. The disk 30 can be made of a flavoring, coloring, vitamins, baby formula, water-purifying chemicals, nutrients, fluoride, electrolyte-affecting chemicals, or any other human-consumable additive that dissolves in a human-consumable liquid, such as water, milk, soft drinks, fruit juices, etc. Preferably, the disk 30 is made entirely of the additive in a solidified form, so that after the disk 30 contacts the liquid and dissolves, there are no remnants of the disk. This complete dissolution of the disk 30 permits use of the invention with medications, with which accurate dosing is essential.

Figure 14:
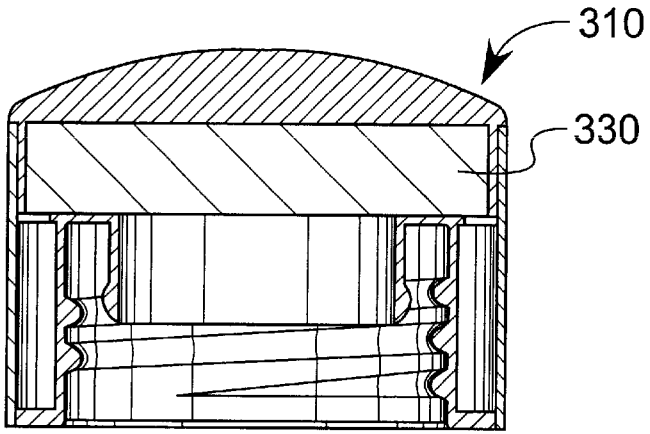
FIG. 14 is a side view in section illustrating another alternative embodiment of the invention.

The disk 30 is formed, in a preferred embodiment, by inverting the cap 10 from the orientation shown in FIG. 3, blocking the cylindrical passage of the spout 36 to provide a temporary "bottom" to the spout 36, and injecting semi-solid or paste material into the chamber. The material subsequently hardens, such as by drying, curing, cooling or reacting with air, to form the solidified disk 30 shown in FIGS. 1 and 3. The aperture 31 in the disk 30 can be formed, for example, by displacing the material with the injecting device or a mold during formation of the disk, or by cutting after solidification. As shown in FIG. 14, the disk 330 can be cylindrical without an aperture, or it can have an aperture (see FIGS. 1–3) or some o other shape with further increased surface area to enhance dissolution.

The bottom surface of the disk 30, in the orientation shown in FIG. 3, seats against the upper surface of the web 28. The top surface of the disk 30 seats against a shoulder 29 that is spaced from the web 28. The web 28 prevents the disk 30 from exiting from the chamber 20 in one axial direction, and the shoulder 29 restricts movement in the opposite axial direction. The sidewall 12 restricts radial movement of the disk 30. Thus, the disk 30 is held rigidly in the cap until it is dissolved in a liquid.

The bottom surface of the disk 30 that seats against the web 28 also blocks the fluid passageways in the web 28, thereby blocking fluid communication between the cavity 18 and the chamber 20 so long as the disk 30 maintains the shape shown in FIG. 3. However, because the disk is liquid-dissolvable, which means it dissolves in the liquid in the bottle, and because at least a portion of the disk 30 is in fluid communication with the chamber 20 at all times, liquid in the chamber will contact the disk 30, thereby dissolving the part with which it comes into contact. Therefore, as the liquid dissolves and carries away the parts of the disk 30 in fluid communication with the chamber 20, new surfaces of the disk 30 are exposed to come into fluid communication with the liquid in the chamber 20. As the liquid contacts those newly exposed surfaces, the particles of the disk 30 are dissolved and carried away. This process continues until the disk 30 is entirely dissolved.

At some time after the disk 30 begins to be dissolved, the region of the disk 30 that blocks the fluid passageways 40 and 42 dissolves away, thereby permitting liquid, with dissolved additive material therein, to enter the cavity 18. The liquid, because it is more dense than the contents of the cavity 18, such as air, displaces the air in the cavity 18 and enters the cavity 18. Once in the cavity, the liquid can perform one or more of many functions described below.

Figure 2:
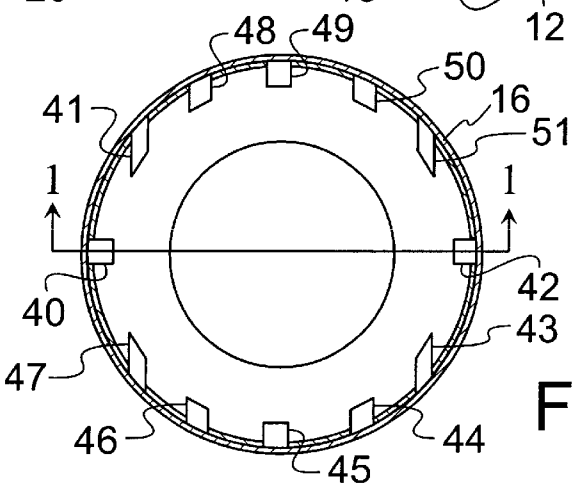
FIG. 2 is a top view in section through the line 2—2 of FIG. 1.

In addition to the fluid passageways 40 and 42, there are preferably fluid passageways 41 and 43–51 as shown in FIG. 2. The number and size of the fluid passageways must be determined based upon the fluid properties of the liquid, the propensity of the disk to dissolve in the liquid, the desired amount of liquid to enter the cavity, the viscosity of the mixture of the additive and liquid, and many other parameters. These parameters will be understood by a person of ordinary skill in the art from the present description.

Figure 4:
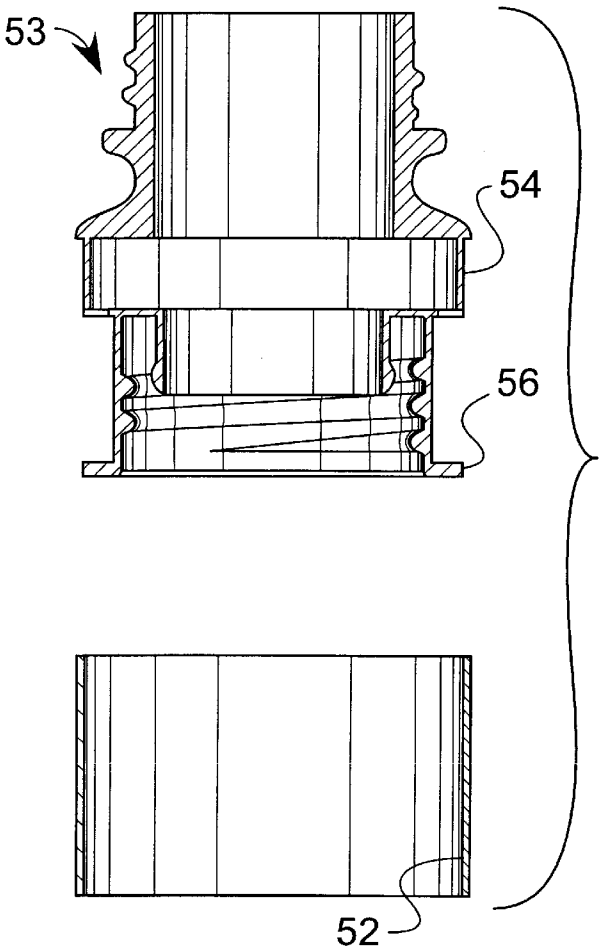
FIG. 4 is a side view in section illustrating the preferred cap prior to assembly.

The cap 10 can be constructed by assembling two separate pieces, illustrated in FIG. 4. The cylindrical collar 52 is pressed onto the lower end of the cap blank 53 in the orientation shown in FIG. 4 until the inner surface of the collar 52 seats against the outwardly facing cylindrical surfaces 54 and 56 of the cap blank 53. The collar 52 can be mounted, such as by an adhesive or by ultrasonic welding, to the cap blank 53 where the two pieces abut one another. After constructing it, the cap can be entirely enclosed in a wrapping, covered only on the ends, mounted on a bottle, mounted on one or more other caps or a combination of these.

Figure 15:
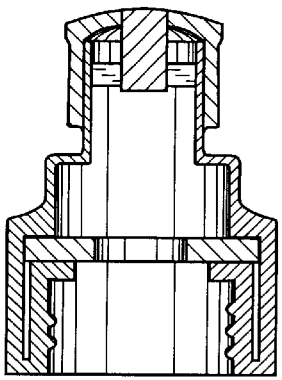
FIG. 15 is a side view in section illustrating another alternative embodiment of the invention.

Once completely constructed, the cap 10 can be simply screwed onto a conventional water bottle, such as the bottle 60 shown in FIGS. 5, 12 and 13. The spout of the cap 10 can then be covered by a conventional cap, or sport-cap 410 having a part that can be displaced axially to open and close the cap 410, as is shown in FIGS. 12 and 13. As shown in FIG. 15, the cap 310 can have a sport-type cap incorporated into its upper end as an integral part of the cap. Thus, assembly is simple and convenient.

Once the cap is mounted on a bottle or other container, the liquid can be brought into contact with the dissolvable disk containing the additive. This is accomplished by simply shaking or inverting the closed bottle, either of which bring the liquid into contact with the disk, thereby causing it to dissolve. After complete dissolution of the disk, the liquid with the dissolved additive therein can be consumed. The invention therefore makes the addition of an additive to a liquid a very simple process that only involves the kinds of steps taken to open or close a conventional water bottle.

Figure 6:
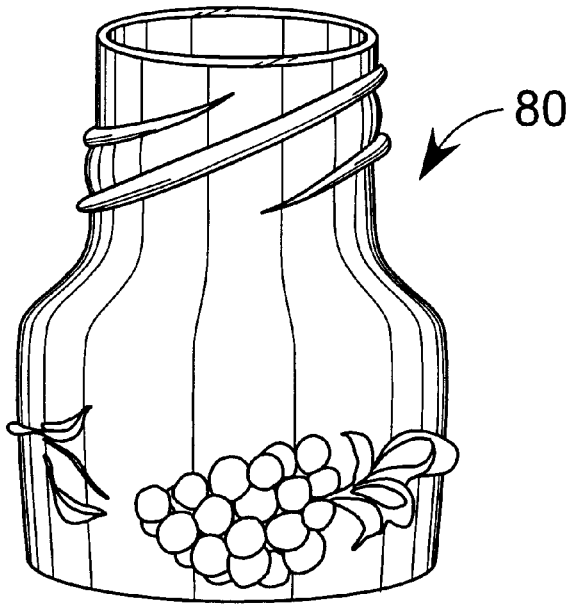
FIG. 6 is a view in perspective illustrating an alternative embodiment of the invention on a bottle.

A significant advantage of the present invention is that, during or after dissolution of the disk, the liquid that has the disk material dissolved in it can be used to give the cap an enhanced appearance. For example, in a simplest embodiment of the invention, the outer surface of the cap has surface texture and imprinted indicia on it, such as is shown in FIG. 6. The cap 80 has an outer wall with indicia in the shape of a cluster of grapes. This simple cap gives an attractive appearance due to the indicia, such as the grape stem and leaf indicia molded and painted or otherwise applied thereto. There is no cavity in the cap 80; only a dissolvable disk in the chamber (not shown) and the outer indicia.

Figure 7:
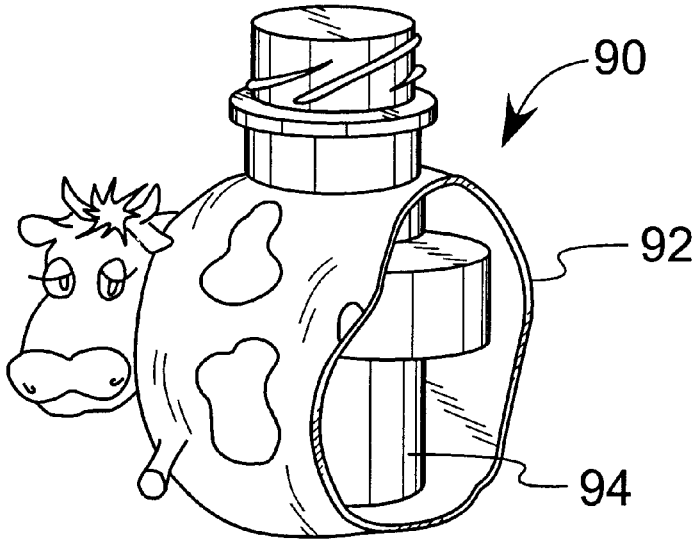
FIG. 7 is a perspective view in section illustrating an alternative embodiment of the invention.

In a different embodiment, as shown in FIG. 7, a cap 90 with cow indicia has a cavity between the outer wall 92 and the inner wall 94 into which the liquid from the container can flow. (The cavity shown has a larger volume than would ordinarily be preferred, but is shown for the sake of illustration.) The outer wall 92 has translucent regions, thereby permitting the user of the cap 90 to see when a colored liquid is in the cavity. If the disk material dissolved in the liquid dramatically changes the color of the liquid, for example from clear to red, the presence of the liquid in the cavity would be evident to any viewer. And if, for example, the spots of the cow are translucent but the rest of the cow is opaque, when the liquid fills the cavity the spots change from translucent to red. This signals the user, for example, that the disk has been dissolved, and that the liquid is ready to be consumed. Of course, any size or shape of translucent regions could be used.

Figure 8:
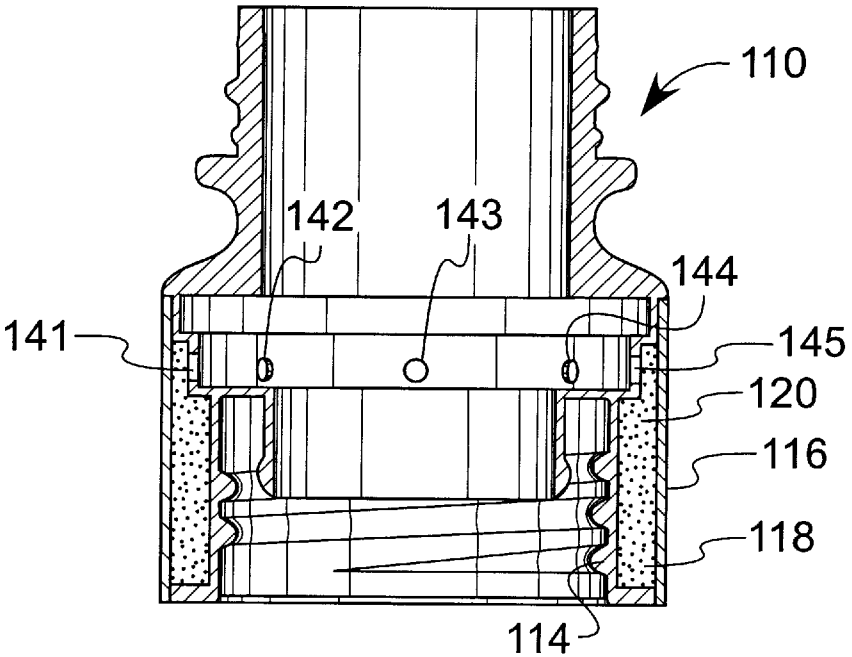
FIG. 8 is a side view in section illustrating another embodiment of the present invention.

Still another embodiment of the present invention is shown in FIG. 8, in which a cap 110 has a cavity 118 formed between an inner wall 114 and an outer wall 116. The cavity 118 contains particulate 120 that dissolves in liquid when the liquid enters the cavity 118 through the radial fluid passageways 141, 142, 143, 144 and 145. This embodiment could be used alone or in combination with a disk of liquid-dissolvable additive material.

Figure 9:
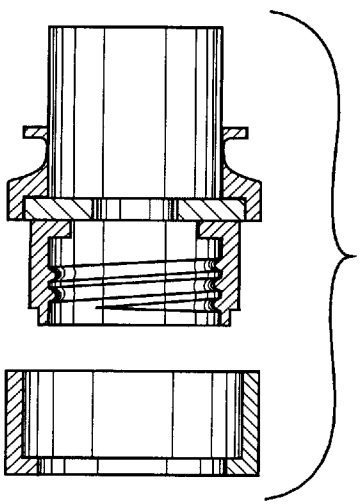
FIG. 9 is a side view in section illustrating an alternative embodiment of the invention prior to assembly.
Figure 10:
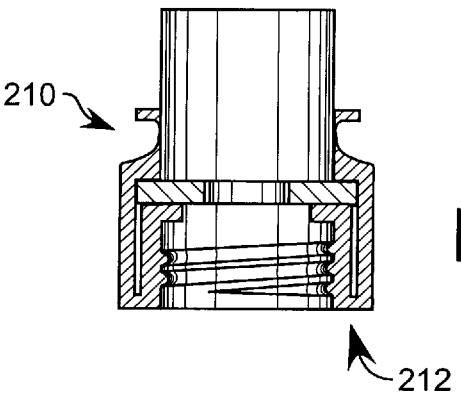
FIG. 10 is a side view in section illustrating the embodiment of FIG. 9 assembled.
Figure 11:
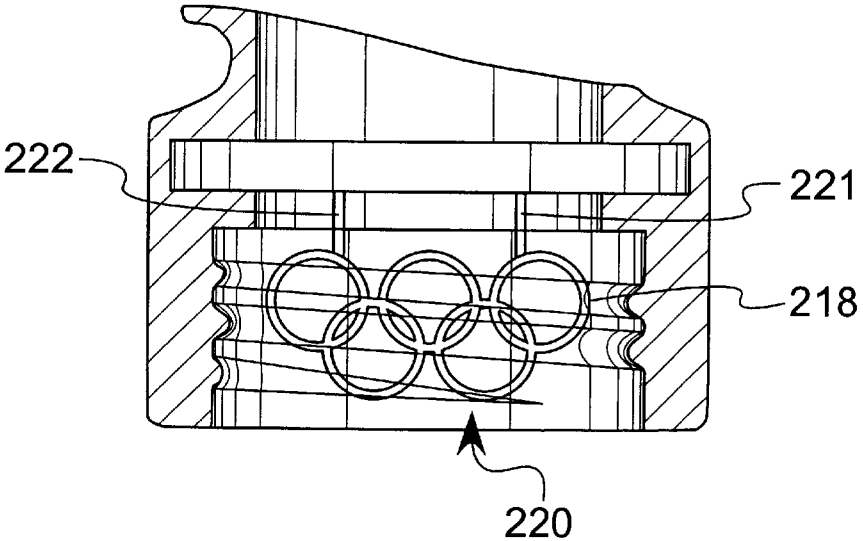
FIG. 11 is a partial side view in section illustrating an alternative embodiment of the invention.

Yet another alternative embodiment of the present invention is shown in FIGS. 9 and 10. The cap 210 is made of two pieces as shown in FIG. 9. The two pieces are combined during a manufacturing process similar to that described above with regard to the FIG. 4 embodiment. However, one different feature of the cap 210 is the discrete cavity formed in the sidewall 212 of the cap 210 as shown in FIG. 11. There is not a circumferentially contiguous cavity all around the cap sidewall 212. Instead, there is one cavity in the sidewall 212, and the cavity has a predetermined shape. Of course, there could be two or more cavities, each cavity separated from each other cavity in the sidewall 212.

The cavity 218 is formed in the sidewall 212 in fluid communication with feeder tubes 221 and 222. The feeder tubes are fluid passageways that extend from the chamber 220, which is in substantially the same location relative to the sidewall 212 as the preferred chamber 20 of FIG. 1 is relative to the sidewall 12. The feeder tubes 221 and 222 permit liquid in the chamber 220 to flow into the cavity 218 and any other cavities in the sidewall 212, thereby filling the cavities and making the contents thereof visible to the user of the cap 210 due to the translucency or transparency of the sidewall 212. In this manner, one or more logos, pictures or other indicia could become visible upon dissolution of the disk in the liquid, which then enters the cavity or cavities.

Although the caps shown and described above have helical threads to mount to a bottle, the structure used to mount the cap to the liquid container could be any conventional structure, including a simple groove on one part and a ridge on the other that is forced into the groove. Furthermore, the cavity or cavities of the above-described embodiments can contain objects, such as particulate, that do not dissolve in liquid. For example, the cavities could contain crystals or other attractive material.

While certain preferred embodiments of the present invention have been disclosed in detail, it is to be understood that various modifications may be adopted without departing from the spirit of the invention or scope of the following claims.

What is claimed is:

1. A cap for mounting on a liquid container, the cap comprising:

(a) a sidewall having an inwardly facing surface defining an interior chamber, the cap sidewall also having an outwardly facing surface;

(b) a receiving end of the sidewall adapted to receive a portion of the liquid container, said receiving end having an opening to the chamber for placing the chamber in fluid communication with liquid in the liquid container;

(c) a top end of the sidewall opposite the receiving end; and (d) a liquid-dissolvable body rigidly mounted to the sidewall within the chamber between the receiving end and the top end, wherein at least part of said body is in fluid communication with said chamber for contacting liquid in the chamber from said liquid container and thereby at least partially dissolving in the liquid.

2. The cap in accordance with claim 1 wherein the body is mounted to the sidewall between facing substantially parallel surfaces that are transverse to a cap axis, which substantially parallel surfaces restrict axial movement of the body, thereby retaining the body in the chamber.

3. The cap in accordance with claim 2, wherein the cap sidewall further comprises an inner wall and an outer wall spaced apart forming at least one cavity therebetween.

4. The cap in accordance with claim 1, wherein the cap sidewall further comprises an inner wall and an outer wall spaced apart forming at least one cavity therebetween.

5. The cap in accordance with claim 4, wherein said liquid-dissolvable body abuts said inner wall and is interposed between said chamber and said at least one cavity.

6. The cap in accordance with claim 4, further comprising at least two fluid passageways extending through the inner wall, said at least two fluid passageways being at least partially blocked by the liquid-dissolvable body which abuts the inner wall at the fluid passageways for restricting fluid flow through the fluid passageways from the chamber to said at least one cavity until after at least a passageway-blocking portion of the liquid-dissolvable body is dissolved.

7. The cap in accordance with claim 4, further comprising at least two fluid passageways extending through the inner wall between said at least one cavity and said chamber for permitting fluid flow from the chamber to said at least one cavity.

8. The cap in accordance with claim 7, wherein said cavity extends circumferentially around the cap sidewall.

9. The cap in accordance with claim 8, wherein said cavity is annular.

10. The cap in accordance with claim 7, wherein said outer wall has a translucent region, thereby permitting light to pass through said translucent region into said cavity for illuminating said cavity.

11. The cap in accordance with claim 10, further comprising substantially opaque indicia on predetermined regions of the outer wall of the cap for preventing light striking the substantially opaque indicia from illuminating said cavity.

12. The cap in accordance with claim 1, further comprising indicia on the outer wall of the cap.

13. The cap in accordance with claim 1, further comprising an aperture formed in said top end of the cap for permitting liquid to flow therethrough from the chamber, and wherein said liquid-dissolvable body is annular and is mounted with a peripheral edge seated against the inwardly facing surface of the cap sidewall, and an aperture formed through the body for permitting the passage of liquid therethrough from the chamber out of the aperture.

14. The cap in accordance with claim 1, wherein the liquid-dissolvable body is made of a material selected from the group of flavoring, vitamins, infant formula, coloring, water-purification chemicals, nutrients, fluoride and electrolyte-affecting chemicals.

15. A cap for mounting on a liquid container, the cap comprising:

(a) a sidewall having an inner wall with an inwardly facing surface defining an interior chamber and an outer wall having an outwardly facing surface, said inner and outer walls being spaced apart in at least one circumferential section of the sidewall, thereby forming at least one cavity therebetween;

(b) a receiving end of the sidewall adapted to receive a portion of the liquid container, said receiving end having an opening to the chamber for placing the chamber in fluid communication with liquid in the liquid container;

(c) a top end of the sidewall opposite the receiving end;

(d) at least two fluid passageways extending through the inner wall between said at least one cavity and said chamber for permitting fluid flow from the chamber to said at least one cavity; and (e) a liquid-dissolvable body rigidly mounted to the sidewall within the chamber between the receiving end and the top end, wherein at least part of said body is in fluid communication with said chamber for contacting liquid in the chamber from said liquid container and thereby at least partially dissolving in the liquid.

16. A drinking apparatus comprising:

(a) a liquid container having a spout and a reservoir containing a human-consumable liquid;

(b) a cap mounted on the spout of said liquid container, said cap comprising:

(i) a sidewall having an inner wall with an inwardly facing surface defining an interior chamber and an outer wall having an outwardly facing surface, said inner and outer walls being spaced apart in at least one circumferential section of the sidewall, thereby forming at least one cavity therebetween;

(ii) a receiving end of the sidewall mounted to the spout of the liquid container, said receiving end having an opening to the chamber thereby placing the chamber in fluid communication with the liquid in the liquid container's reservoir;

(iii) a top end of the sidewall opposite the receiving end;

(iv) at least two fluid passageways extending through the inner wall of the cap between said at least one cavity and said chamber for permitting fluid flow from the chamber to said at least one cavity; and (v) a liquid-dissolvable body rigidly mounted to the sidewall within the chamber between the receiving end and the top end, wherein at least part of said body is in fluid communication with said chamber and the liquid container's reservoir for at least partially dissolving the body in the liquid.

* * * * *